US006482468B1

(12) United States Patent
Haas

(10) Patent No.: US 6,482,468 B1
(45) Date of Patent: Nov. 19, 2002

(54) METHOD AND DEVICE FOR POWDERING PRINTED SHEETS

(75) Inventor: Reiner Haas, Metzingen (DE)

(73) Assignee: Weitmann & Konrad GmbH & Co., (DE)

( * ) Notice: Subject to any disclaimer, the term of this patent is extended or adjusted under 35 U.S.C. 154(b) by 0 days.

(21) Appl. No.: 09/744,853

(22) PCT Filed: Aug. 6, 1999

(86) PCT No.: PCT/EP99/05447

§ 371 (c)(1),
(2), (4) Date: Mar. 2, 2001

(87) PCT Pub. No.: WO00/09338

PCT Pub. Date: Feb. 24, 2000

(30) Foreign Application Priority Data

Aug. 10, 1998 (DE) ..... 198 36 018

(51) Int. Cl.[7] ..... B05D 1/12; B41F 23/06

(52) U.S. Cl. ..... 427/202; 427/180; 427/424; 118/308; 118/314; 118/690; 101/424.2

(58) Field of Search ..... 427/180, 202, 427/8, 424, 427; 118/300, 308, DIG. 1, 689, 690, 314, 315; 101/424.2, 492, 424.1

(56) References Cited

U.S. PATENT DOCUMENTS

| | | | | |
|---|---|---|---|---|
| 4,622,896 | A | | 11/1986 | Laverick |
| 4,867,063 | A | | 9/1989 | Baker et al. |
| 4,882,992 | A | * | 11/1989 | Schmoeger |
| 5,163,370 | A | | 11/1992 | Platsch |
| 5,713,285 | A | * | 2/1998 | Reed et al. |

FOREIGN PATENT DOCUMENTS

| | | | |
|---|---|---|---|
| DE | 199 37 090 | | 2/2000 |
| DE | 199 37 557 | | 3/2000 |
| GB | 703 092 | | 1/1954 |
| JP | 63030250 | | 2/1988 |
| JP | 2-076738 | * | 3/1990 |

* cited by examiner

*Primary Examiner*—Fred J. Parker
(74) *Attorney, Agent, or Firm*—Young & Basile, PC

(57) ABSTRACT

The invention relates to a method and a device for powdering printed paper sheets. According to the invention, the performance of the air-pressure generator which generates the air stream for the powder-air mixture can be adjusted in line with the machine speed or the speed of transportation of the paper sheets.

17 Claims, 1 Drawing Sheet

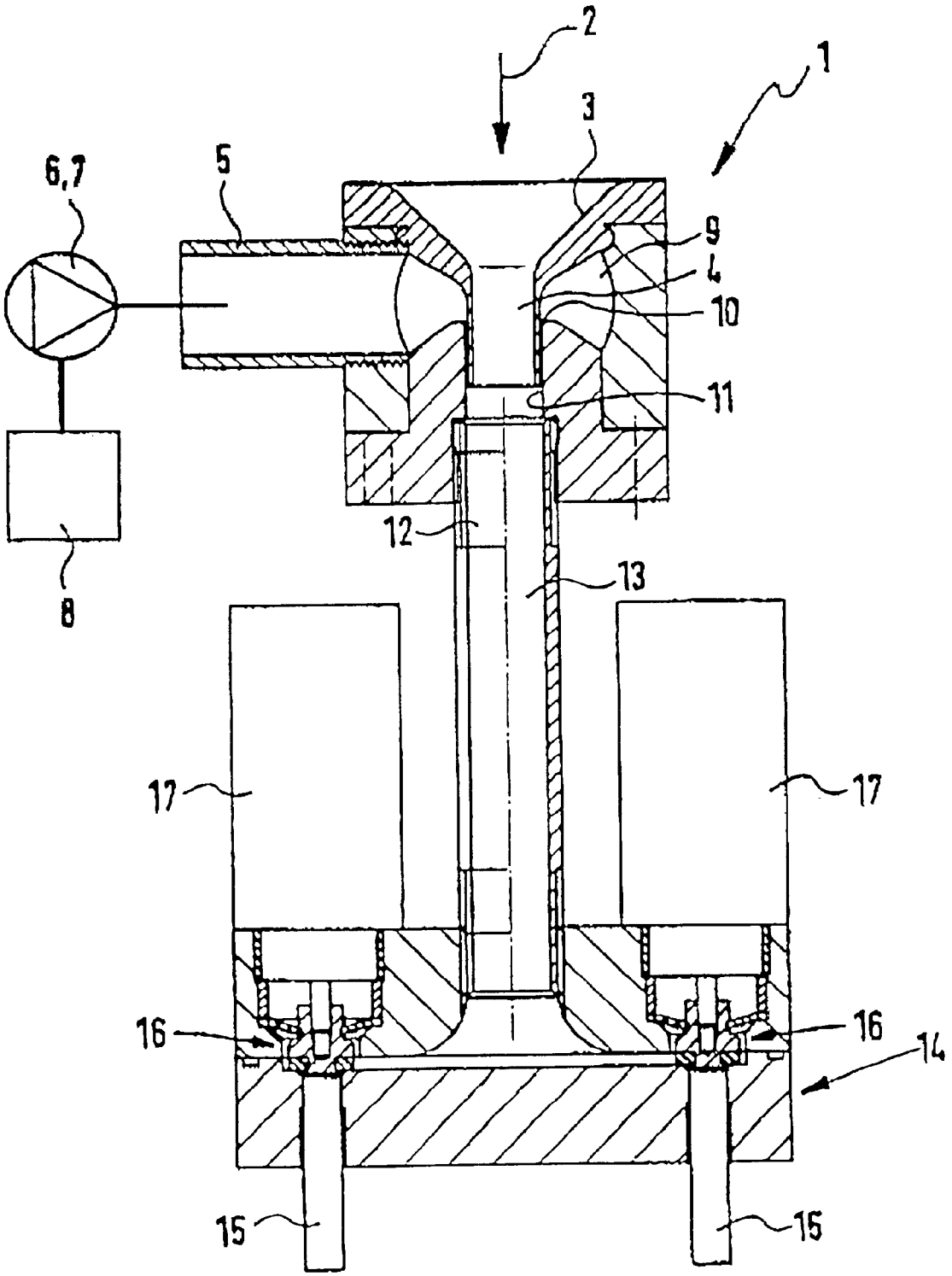
2
1
3
6,7
5
9
4
10
11
12
13
8
17
17
16
16
14
15
15

METHOD AND DEVICE FOR POWDERING PRINTED SHEETS

BACKGROUND

The invention pertains to a method for powdering printed sheets, wherein the powder is removed from a supply container and mixed with air in a mixing device, the powder is distributed by an air stream and applied onto the sheet by a nozzle unit that, if so required, can be adapted to the width of the sheet, the number of outlet openings or the outlet cross section, in particular, of said nozzle unit is changed correspondingly, and the air stream is generated by an air pressure generator. The invention also pertains to a device with a supply container for the powder, a mixing device, in which the powder is mixed with the air stream, an air pressure generator for generating the air stream, and a nozzle unit, from which the air stream containing the powder is discharged and blown onto the sheet, wherein the nozzle unit contains several outlet openings or an outlet cross section that allows the nozzle unit, if so required, to be adapted to the width of the sheet.

It is known, for example, that paper sheets printed by a printing machine are stacked by means of a sheet stacking device. Before the stacking process, the sheets are powdered such that the still moist printing color does not smear during the stacking process. A powdering device, in which powder is mixed with an air stream, is used for powdering the sheets, and the air stream containing the powder is blown onto the surface of the sheet. A nozzle unit that, for example, is mounted on a nozzle beam that extends over the entire width of the sheet transverse to the transport direction is used for this purpose. In order to maintain the powder loss as well as the soiling of the sheet stacking device and the printing machine at a minimum, the active region of the nozzle unit is adapted to the width of the sheet. This is realized by switching on or off individual nozzles or by adapting the outlet cross section to the width of the sheet. For example, if nozzles are switched off, i.e., if the outlet openings of these nozzles are closed, the pressure drop between the blower that generates the air stream and the outlet openings changes. The compressed air made available by the blower now must be discharged through a smaller number of nozzles and a respectively smaller outlet cross section, whereby the flow speed as well as the pressure gradient change so that the air emerging from the nozzles is discharged with a higher speed. Due to the lower pressure drop that occurs if a smaller quantity of outlet nozzles remains open, less powder is stirred up in the mixing device that is constructed in the form of a turbulence chamber, so that less powder is concentrated and, thus, distributed in the air. The specific powder volume which is distributed for a narrow sheet consequently is lower than that for a wider sheet. In addition, the quantity of powder required is highly dependent on the transport speed of the printed paper sheets.

SUMMARY OF THE INVENTION

The invention provides a method and/or a device by means of which the specific powder volume admixed in the air stream and, consequently, the distributed powder volume can be adapted to the instantaneous requirements of the sheet in a superior fashion. In a method of the initially mentioned type, this is attained according to the invention due to the fact that the performance of the air pressure generator can be changed, in particular, continuously during the operation.

According to one aspect, the performance of the air pressure generator is adapted to the machine speed or the transport speed of the paper sheets. The method according to the invention essentially provides the advantage that the distributed quantity of powder can be exactly adapted to the requirements of the paper sheet. Consequently, compromises with respect to a slow operating speed and a normal operating speed are eliminated. When starting the operation or reducing the speed, the powder quantity is automatically reduced.

According to other aspects of the invention, the performance of the air pressure generator can also be adapted to other ambient conditions, if so required. These conditions pertain, for example, to the printing material, the size of the printed surface, the printed image, the type of powder, the type of paper, the relative humidity and the temperature. Suitable sensors are provided for this purpose. These sensors forward the measured data, in particular, control currents, to a control unit of the air pressure generator.

According to another refinement, the power of the air pressure generator is adapted to the number of open outlet openings or to the outlet cross section. Due to this measure, wide sheets that, for example, are powdered by 12 nozzles are provided with the air quantity required for this purpose, and a lesser quantity of air is supplied for narrower sheets (e.g., with a half-format) that, for example, are powdered by six nozzles. Consequently, the air volume discharged per nozzle remains the same. This also ensures that the quantity of powder per nozzle remains the same. This means that the performance of the air pressure generator is reduced if the number of outlet openings or the outlet cross section is reduced. In this case, the performance of the air pressure generator can be linearly adapted.

According to yet another refinement, the powder is removed from the supply container by means of a fixed metering device, e.g., a drum metering device or a cell metering device. The exact quantity of powder required for powdering the respective sheet can be withdrawn by the fixed metering device. If one or more nozzles are switched off for powdering narrower sheets, the quantity metered by the fixed metering device is correspondingly reduced. According to a refinement, the pressure of the air stream is adjusted to a value between 0.1 bar and 0.5 bar, in particular, 0.3 bar. A relatively large air volume provided by the air pressure generator corresponds to this low pressure. Consequently, the pressure of the air stream can be maintained at a constant value independently of the number of open outlet nozzles.

According to one preferred aspect of the invention, a side channel compressor is used as the air pressure generator. This compressor requires no maintenance and is not sensitive to dust. In conventional powdering devices, rotary vane compressors are used. However, these compressors require regular and relatively frequent maintenance. In addition, the vanes must be exchanged relatively often. Another problem is that rotary vane compressors must run dry because the air must be free of oil, and, thus, wear is promoted. Rotary vane compressors of this type also generate a relatively high pressure of approximately 1 bar and only a small volume. Rotary vane compressors can only be operated within a very narrow speed range, where this speed range of 2860 l/min to 3430 l/min corresponds to a frequency of 50–60 Hz. At low rotational speeds, the pressing force of the vanes is low resulting in an insufficient seal. At higher rotational speeds, the pressing force becomes excessively high due to the centrifugal force such that the wear increases impermissibly.

The power of the side channel compressor is preferably controlled or regulated with the aid of a frequency converter.

Due to this measure, the rotational speed of the compressor and consequently its performance can be adapted relatively easily to the respective requirements. The frequency can be adjusted, for example, between 0 and 100 Hz such that a rotational speed range between 0 and 6000 l/min is achieved.

According to one refinement, an injector is used as the mixing device. In this injector, the air stream is realized in the form of an enveloping air jet, into which the powder is attracted by suction. This provides the significant advantage in that the suction tube can be arranged vertically and the powder must merely drop from the metering device due to gravitational force in order to be transported into the enveloping air jet. Consequently, the transport direction of the powder does not have to be deflected and, thus, no transport medium is required since, as mentioned above, the gravitational force suffices for transporting the powder into the air stream.

According to the invention, the compressor can be controlled by a sensor. This sensor determines the speed of the paper web or another component that is related to the speed of the paper web, e.g., the rotational speed of a driving motor or the like. The quantity of powder being withdrawn can be controlled exactly in this fashion.

The sensor determines, for example, the number of open outlet openings or the outlet cross section and controls the compressor drive correspondingly. However, sensors which determine the volume flow or the pressure in the air stream could also be used. For example, the compressor can be adjusted by means of a pressure sensor in such a way that a uniform pressure always exists in the powder/air stream. However, it would also be conceivable to provide sensors for determining the quantity of the powder contained in the air stream. The abovementioned sensors may be provided alternatively or simultaneously. In addition, it would also be conceivable to provide sensors which determine the printing material, the size of the printed surface, the printed image, the powder type, the paper type, the relative humidity, and the temperature. In this case, the performance of the air pressure generator is varied depending on the sensor data. The paper sheet is always powdered with an optimum amount of powder in this fashion.

The device according to the invention contains an injector in which the air stream is used as the driving air. The driving air is conveyed around a suction line, into which surrounding air is attracted by suction and the powder is attracted by suction with this ambient air. This suction line can be directly connected to the fixed metering device such that the conveyed powder is entrained in the surrounding air. According to the invention, the fixed metering device may consist of a metering drum that is described, e.g., in patent application serial nos. DE 199 37 090.7 and DE 199 37 557.7

BRIEF DESCRIPTION OF THE DRAWING

Additional advantages, characteristics and details of the invention result from the subordinate claims as well as the following description, in which one particularly preferred embodiment is described in detail with reference to the single drawing figure. The characteristics illustrated in the single drawing figure and mentioned in the claims as well as in the description are significant for the invention either individually or in arbitrary combinations.

DETAILED DESCRIPTION

The single drawing figure shows a mixing device of a device for powdering printed paper sheets which is identified in entirety by the reference numeral 1. In this mixing device 1, powder is conveyed in the direction of the arrow 2 from a (not-shown) supply container by a (not-shown) fixed metering device. This fixed metering device is arranged directly above the mixing device 1 such that the conveyed powder drops directly into a funnel 3 from the fixed metering device. This funnel 3 flows into a suction line 4 that is arranged directly underneath the funnel 3 a short distance from the fixed metering device.

A line 5, by means of which compressed air is supplied to the mixing device 1, also flows into the mixing device 1. This compressed air is generated by an air pressure generator 6 which is realized in the form of a compressor, in particular, a side channel compressor 7 that is controlled by a frequency changer or a frequency converter 8. The line 5 flows into a distribution chamber 9, in which the air is uniformly conveyed around the suction line 4. A sleeve-shaped air channel 10 is connected to this distribution chamber 9. The sleeve-shaped air channel 10 is formed by arranging the suction line 4 within a bore 11 and at a distance from the inner wall of the bore such that the air in the distribution chamber 9 is conveyed into an outlet 12 between the suction line 4 and the bore 11. Since the cross section of the sleeve-shaped air channel 10 is relatively small, the air in the channel 10 is accelerated to a high speed such that a vacuum is generated in the suction line 4 and air is entrained from the suction line 4 in the direction of the outlet 12. Due to this vacuum, however, the powder that drops into the funnel 3 is also conveyed in the direction of the outlet 12 where it is mixed with the compressed air generated by the side channel compressor 7.

The drawing figure clearly indicates that the powder which is conveyed in the direction of the arrow 2 must merely drop into the funnel 3, and from there it is attracted by suction. The transport direction of the powder is vertically downward, and the transport is preferably realized due to gravitational force. A transport line 13 that transports the powder/air mixture into an annular distributor 14 is connected to the outlet 12. In this annular distributor, the powder/air mixture is distributed over several individual lines 15, via which the mixture is conveyed to the individual outlet nozzles. The individual lines 15 can be closed by means of valves 16, wherein the valves 16 are actuated, for example, by means of electromagnets 17.

If one or more powdering nozzles are deactivated, e.g., by closing individual lines 15 by means of the valves 16, the powdering device is adapted to sheets of smaller width and the conveyed powder volume is reduced by reducing the performance of the fixed metering device. In addition, the volume of the compressed air stream can also be reduced by means of the frequency converter that reduces the rotational speed of the side channel compressor 7. Although this causes a reduction in the suction performance in the suction line 4, exactly the required quantity of powder which was admixed by the fixed metering device is discharged through the still open powdering nozzles. In addition, the volume of the air that contains powder can be maintained. The volume of the air that contains powder and is discharged per powdering nozzle can also be maintained independently of the number of activated nozzles by adapting the blower 6.

In any case, the same quantity of powder is discharged per powdering nozzle.

It should also be mentioned that if one or more powdering nozzles are deactivated such that the resistance in the annular distributor 14 is increased, the power of the side channel compressor 7 is reduced such that air as well as powder is not discharged toward the outside via the suction line 4 due to the increased dynamic pressure in the annular distributor and consequently the outlet 12 of the mixing device 1. The adaptation of the compressor power ensures that a permanent vacuum is present in the suction line 4.

What is claimed is:

1. A method for powdering printed sheets of paper comprising the steps of:

removing a powder from a supply container and mixing the powder with air in a mixing device;

distributing the powder from the mixing device by an air stream;

applying the powder onto the sheet by a nozzle unit that is adaptable to a width of the sheet by changing one of a number of outlet openings feeding powder to the nozzle unit and an outlet cross section of the nozzle unit based on a measurement of the paper size;

generating the air stream with an air pressure generator;

modifying the airflow from the air pressure generator based on one of the number of active outlet openings, the outlet cross section area, and a transport speed of the paper sheets; and reducing air flow when one of the number of outlet openings and the outlet cross section area of the nozzle is reduced based on a change in the width of the paper sheet.

2. The method according to claim 1 further comprising the step of:

varying the output of the air pressure generator linearly with respect to the number of openings receiving air flow.

3. The method according to claim 1 further comprising the step of:

adjusting the pressure of the air stream to a value between 0.1 bar and 0.5 bar.

4. The method according to claim 1 further comprising the step of:

maintaining the air stream pressure to a constant value.

5. The method according to claim 1 further comprising the step of:

using a side channel compressor as the air pressure generator.

6. The method according to claim 5 further comprising the step of:

regulating the performance of the side channel compressor with a frequency converter.

7. The method according to claim 1 further comprising the step of:

using an injector as the mixing device.

8. The method according to claim 7 further comprising the step of:

forming an air stream with an enveloping air jet into which the powder is attracted by suction.

9. The method according to claim 1 further comprising the step of:

admitting powder to the air stream with a fixed metering device.

10. The method of claim 3 further comprising the step of:

adjusting the pressure of the air stream to a value of 0.3 bar.

11. A device for powdering a printed sheet comprising:

a supply container for holding a powder, a mixing device in which the powder is mixed with an air stream, an air pressure generator for generating the air stream, and a nozzle unit from which the air stream containing the powder is discharged and blown onto a sheet;

the nozzle unit having a plurality of outlet openings, each with an outlet cross section, the nozzle unit can be adapted to the width of the sheet by modifying the number of open outlets, the airflow generated by the air pressure generator is changed continuously during operation in response to at least one sensor; and the at least one sensor being capable of detecting at least one of the width of the sheet, the volume of the powder and air mixture, the pressure of the powder and air mixture, the proportion of the powder in the mixture, the number of open outlet openings and the outlet cross sectional area of the nozzles.

12. The device according to claim 11, wherein the airflow produced by the air pressure generator can be adapted to correspond with the number of open outlets, the outlet cross section of the nozzle unit, and the transport speed of the paper sheets.

13. The device according to claim 11, wherein the air pressure generator further comprises a side channel compressor.

14. The device according to claim 13, wherein the side channel compressor contains a frequency converter.

15. The device according to claim 11, wherein the mixing device includes an injector having an air channel for flowing air around a suction line thereby creating a low pressure vacuum in the outlet of the mixer for mixing the powder with the air stream as the air stream enters the transport line.

16. The device according to claim 15, wherein the injector contains a central suction line for the powder, and the air stream flows axially around the suction line and in the direction of an outlet.

17. The device according to claim 11, wherein a fixed metering device for the powder is provided at an outlet of the supply container.

* * * * *